US007507889B2

(12) United States Patent
Montgomery

(10) Patent No.: US 7,507,889 B2
(45) Date of Patent: Mar. 24, 2009

(54) COMPRESSION ADJUSTABLE STRAP

(76) Inventor: Thomas E Montgomery, 8326 SE. 28th Ave., Portland, OR (US) 97202

( * ) Notice: Subject to any disclaimer, the term of this patent is extended or adjusted under 35 U.S.C. 154(b) by 0 days.

(21) Appl. No.: 11/622,929

(22) Filed: Jan. 12, 2007

(65) Prior Publication Data

US 2007/0163419 A1 Jul. 19, 2007

Related U.S. Application Data

(60) Provisional application No. 60/758,645, filed on Jan. 14, 2006.

(51) Int. Cl.
*G10D 3/00* (2006.01)
*G10G 5/00* (2006.01)

(52) U.S. Cl. ..... 84/327; 224/264

(58) Field of Classification Search ..... 84/327; 224/264

See application file for complete search history.

(56) References Cited

U.S. PATENT DOCUMENTS 2,695,740 A * 11/1954 Kolbe ..... 224/175
4,148,423 A * 4/1979 Schlacher ..... 224/258
4,543,772 A * 10/1985 Mitchell ..... 54/2
4,858,801 A * 8/1989 Sameniego ..... 224/264
4,878,606 A * 11/1989 Miller ..... 224/625
5,292,044 A * 3/1994 Reimers ..... 224/264
5,570,824 A * 11/1996 Lyon et al. ..... 224/240
6,223,508 B1 * 5/2001 Schneider ..... 54/36
6,626,335 B1 * 9/2003 Dunlop ..... 224/258
6,681,973 B2 * 1/2004 Crumrine ..... 224/637
7,060,889 B2 * 6/2006 Bellak ..... 84/741
2006/0027616 A1 * 2/2006 Ranen ..... 224/264
2007/0163419 A1 * 7/2007 Montgomery ..... 84/327

* cited by examiner

*Primary Examiner*—Walter Benson
*Assistant Examiner*—Robert W Horn
(74) *Attorney, Agent, or Firm*—patenttm.us

(57) ABSTRACT

An adjustable strap has a first portion having a tunnel therein to slidingly receive a second strap portion therein. In use, compression of the first portion secures the relative position of the strap portions.

20 Claims, 5 Drawing Sheets

COMPRESSION ADJUSTABLE STRAP

BACKGROUND OF THE INVENTION

This invention relates to straps for use with guitars, purses or other articles to be carried by use of a strap worn over the wearer's shoulders and back.

Current adjustable straps, such as guitar straps, use a plastic slider, a buckle, or a system of slits in the main strap that the tail strap runs through and then through the end in the tail strap. The first is most effective on thin cloth; the last two have most of the weight carried at one point. The concentration of stress on a small and specific location (the buckle or slit) is a possible point of failure for the strap. Also, concentration of the weight at one point can lead to discomfort for the user.

SUMMARY OF THE INVENTION

In accordance with the invention, a strap is provided that is adjustable and allows both ends of the strap to be carried over the shoulder. The strap comprises at least 2 strap portions, one strap portion being carried inside the other, forming one strap out of two through compression of the main outer strap on the inner tail strap.

Accordingly, it is an object of the present invention to provide an improved strap.

It is another object of the present invention to provide an improved guitar strap.

It is a further object of the present invention to provide an improved guitar strap that distributes the weight over a larger area.

It is yet another object of the present invention to provide an improved guitar strap that is improved in comfort to the user.

It is yet another object of the present invention to provide an improved guitar strap that is not prone to bunch up in the back when in use.

It is yet another object of the present invention to provide an improved guitar strap that has an appearance of being a one piece strap.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

The according to a preferred embodiment of the present invention the strap comprises two interacting straps, a main strap and a tail strap slidingly received within a portion of the main strap with compression between the strap portions providing adjustable length setting.

Figure 1:
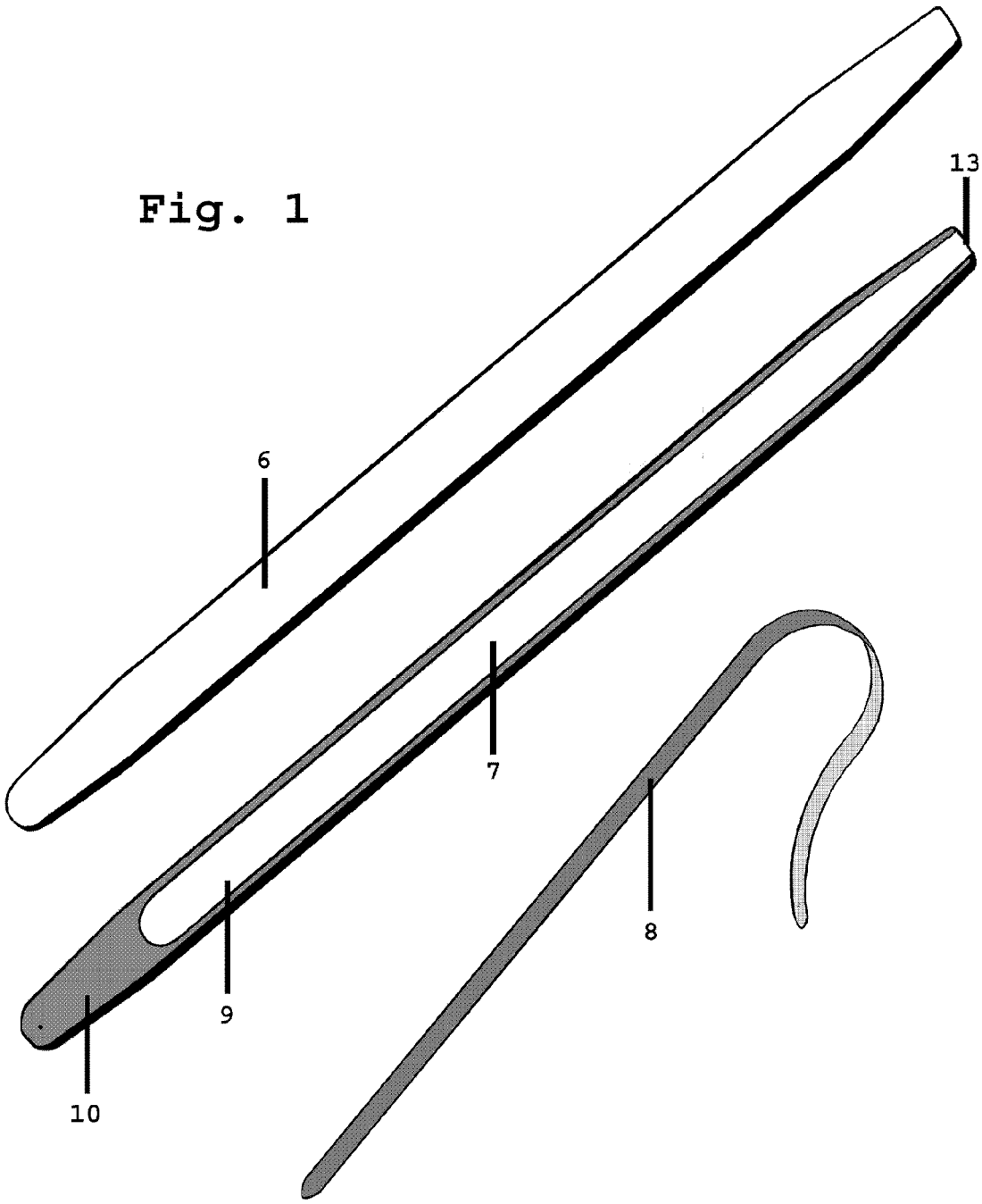
FIG. 1 is an exploded view of the elements of the compression adjustable strap in accordance with the invention.

FIG. 1 shows an exploded view of a main strap 16 that is suitably constructed of two pieces, main top 6 and main bottom 7. The main top 6 is preferably of a soft and flexible material. The main bottom 7 can be the same thickness or of thicker material, than the top. One such suitable material for the portions 6 and 7 is leather.

Figure 2:
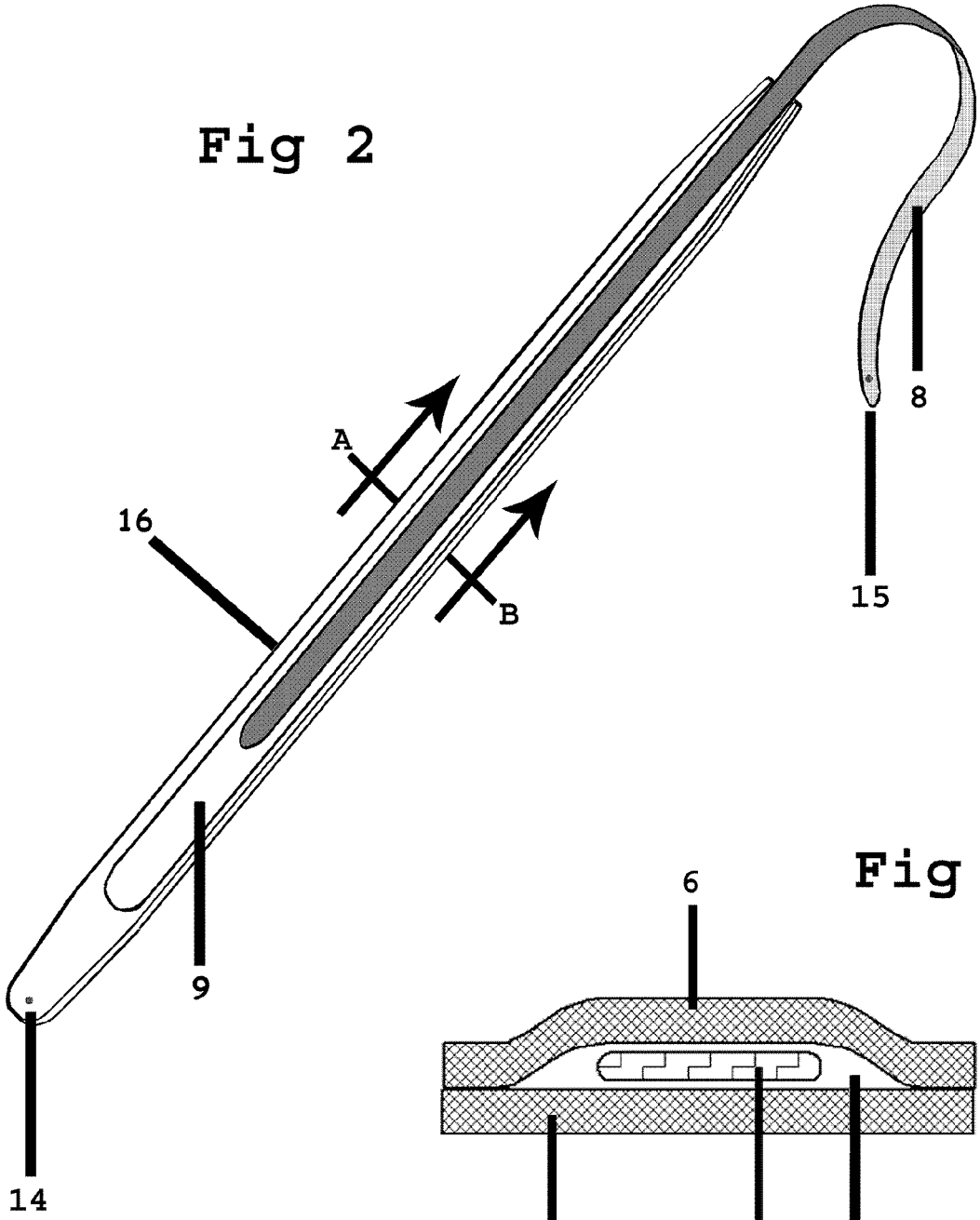
FIG. 2 is a view of the assembled strap with a cut away portion to illustrate the inner chamber with the tail strap in place.
Figure 3:
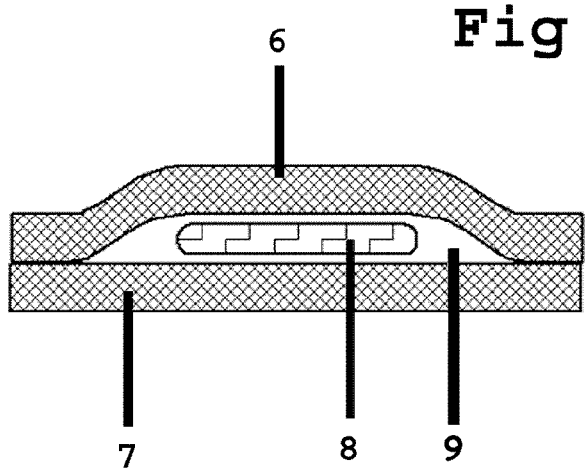
FIG. 3 is a cross section view of the strap at line A/B of FIG. 2.

In FIG. 1, a shaded area 10 of the main bottom 7 is suitably provided with an adhesive or glued or is stitched around the edges within shaded area 10, or both, to join main bottom 7 to main top 6. This arrangement creates a tunnel 9, visible in FIG. 1 and FIG. 3. The tunnel suitably runs almost the entire length of the assembled main strap 16, FIG. 2 (shown with a cutaway portion to illustrate the interior tunnel 9. When assembled, the main strap 16 includes an opening 13 at one end thereof A tail strap 8 shown in FIG. 1 is provided, being narrow enough to fit in the tunnel 9, suitably being made of a stiff material. A preferred material is a leather harness strap. FIG. 2 shows the tail 8 strap inserted into the tunnel 9 of the assembled main strap 16. FIG. 3 shows a cross section of the main strap and the tail strap taken along line A-B of FIG. 2.

At the tip of the main strap 16 and end of the tail strap 8 are standard holes 14 and 15, suitably sized and provided with a slit to accept the mounting buttons on a typical guitar. These may be modified to meet the particular mounting element on the guitar.

Figure 4:
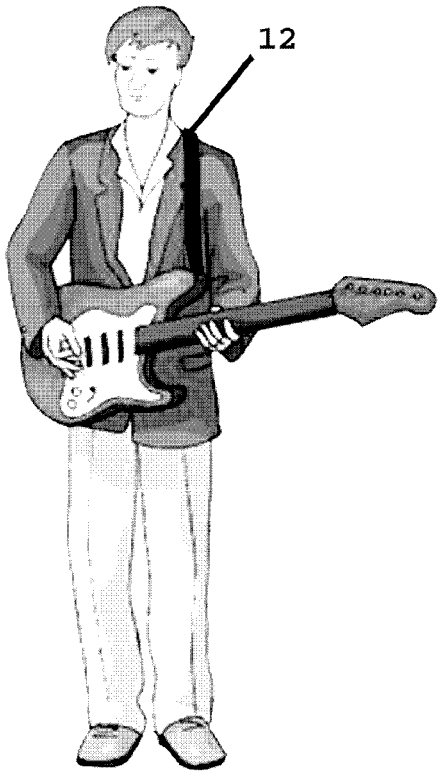
FIG. 4 is a view of a guitar player using the strap to support a guitar, with weight on the strap.

Referring to FIG. 4, the strap is suitably designed to hold up, for example, a guitar while being played. To achieve this, the main strap 16 (FIG. 2) is assembled. The top main 6 is attached to the bottom main 7 (FIG. 1), the attachment is done in the shaded area 10 of bottom main 7. As noted, this can be done with adhesive such as glue or stitching or both. The assembled main strap 16 now has an opening at one end with tunnel that runs almost the entire length and is closed at the other end. The tunnel is suitably long enough to allow the tail strap to be carried over the shoulder when in use. The tunnel in the main strap 16 allows the tail strap 8 to slide in and out to adjust length. The main strap 16 should be long enough to go over the shoulder and down the back, as this will allow the whole strap to be adjusted to desired length.

The tail strap 8 is suitably narrow enough to fit through the tunnel 9. The tail strap 8 should be long enough to go over the shoulder and have enough length to adjust to a variety of desired lengths.

The end of the main strap 16 is placed over the guitar button via a standard hole with a slit 14. The tail strap 8 is placed over the guitar button via a standard hole with a slit 15. When the guitar is attached to the strap the strap is placed over the user's shoulder 12 (FIG. 4), allowing the main strap 16 to be over the shoulder and the tail strap 8 also is over the shoulder inside the tunnel 9.

Figure 5:
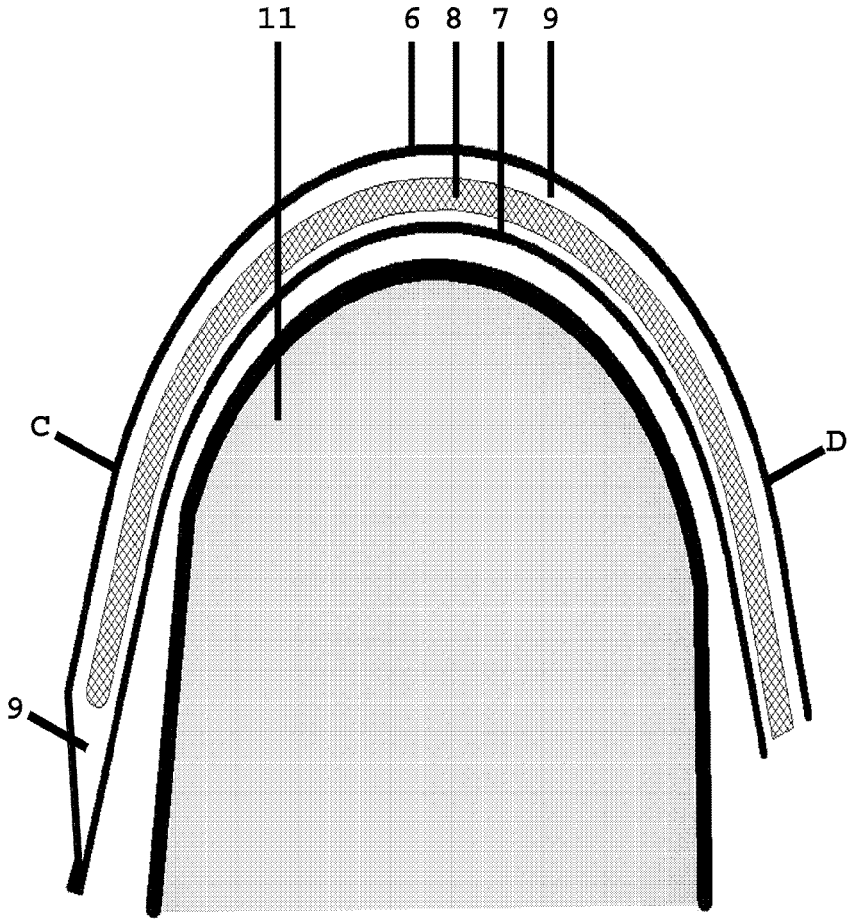
FIG. 5 is a cutaway view of a portion of the strap taken length wise, with weight on the strap over a guitar player's shoulder.

Referring now to FIG. 5, a section view of the strap taken along line A-B of FIG. 2, the strap when in use is illustrated as placed over the shoulder 11. The weight of the guitar or other article on the main strap 16 and on the tail strap 8 in opposing directions collapses the tunnel 9 and compresses the strap in the area between C and D over the shoulder 11. This compression holds the strap 16 and the tail strap 8 together simulating a one piece strap. To adjust the length of the strap the main strap 16 is desirably as flat as possible because a bend in the strap well cause compression even without weight applied. An adjustment keeping device may be placed at the end 13 of the tunnel 9 on main bottom 7, to assist in keeping the tail strap 8 in place when weight is taken off the strap.

Figure 6:
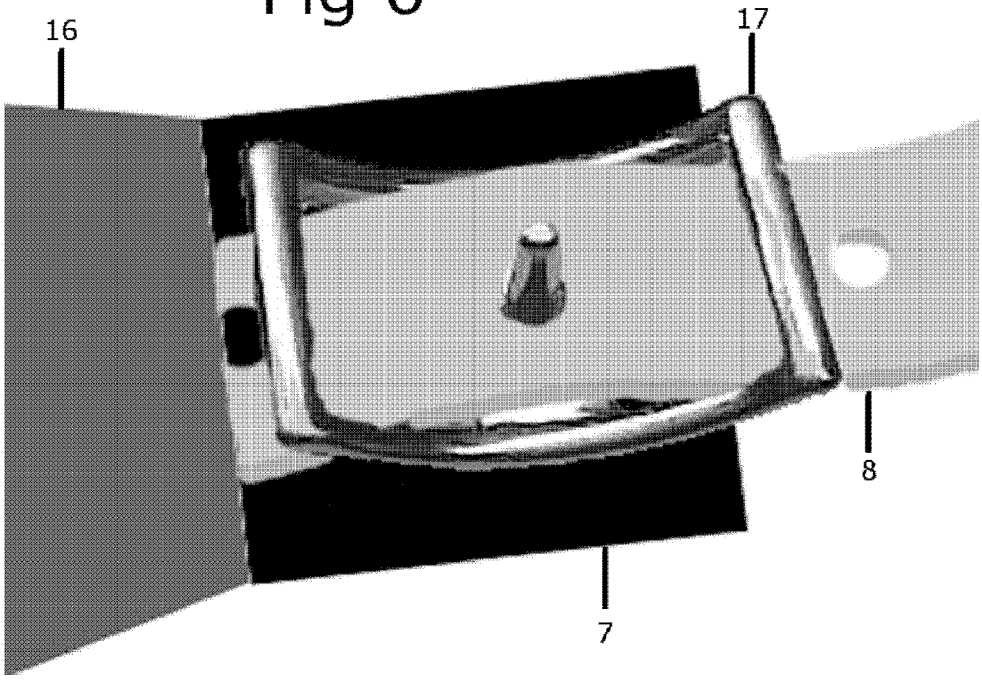
FIG. 6 is a view of a Conway Buckle as an adjustment keeping device.
Figure 7:
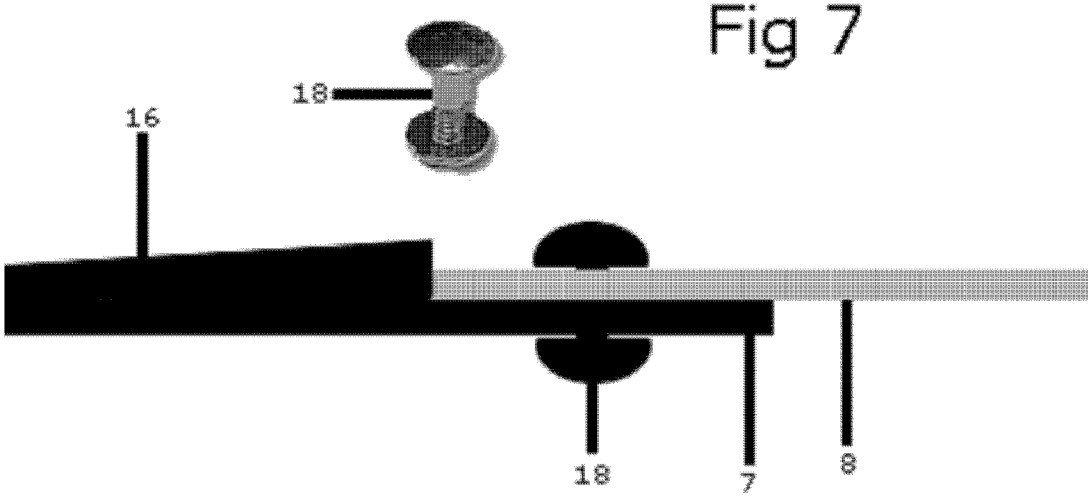
FIG. 7 is a view of a Chicago Screw as an alternate adjustment keeping device.
Figure 8:
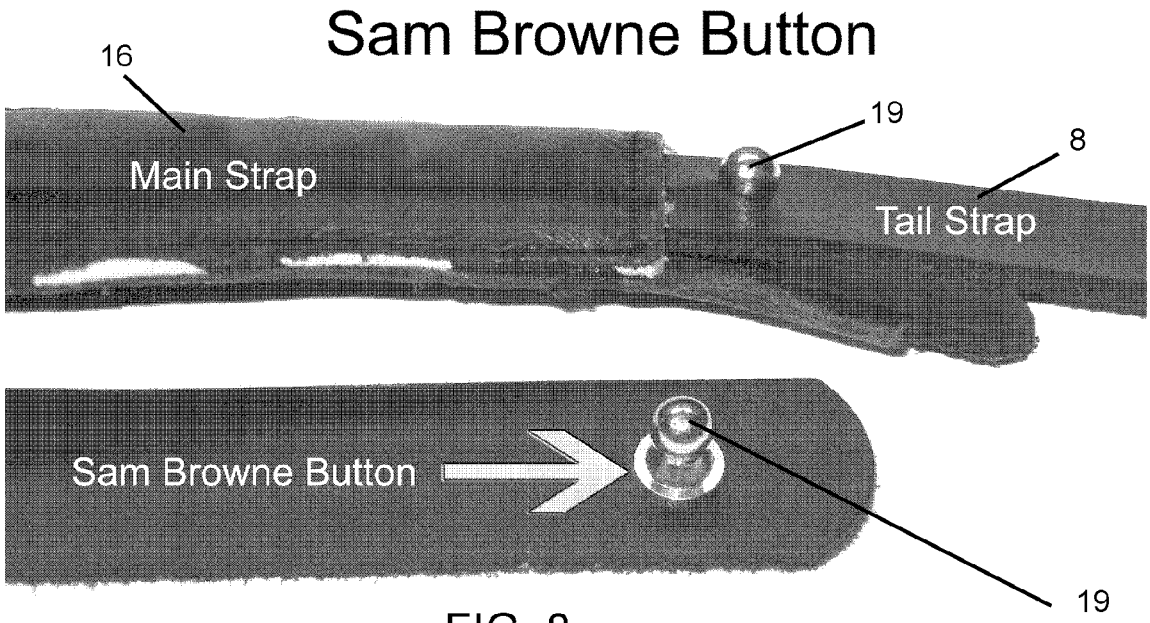
FIG. 8 is a view of a Sam Browne button as another alternate adjustment keeping device.

FIG. 6, FIG. 7 and FIG. 8 show possible adjustment keeping devices, but the selection is not limited to these illustrated adjustment keepers. FIG. 6 shows a Conway Buckle 17 (a buckle often used in horse tack) and FIG. 7 shows a Chicago Screw 18 (binder Post and screw). The adjustment keeper is placed at the end 13 of the tunnel 9 on main bottom 7 witch is extended to attach the adjustment keeping device. The Conway Buckle 17 suitably may be attached as a normal buckle on a belt. The Chicago Screw 18 suitably may be accepted through a hole in the same location of the Conway Buckle 17 post. FIG. 8 shows a Sam Browne button 19 employed as an adjustment keeping device.

The tail strap 8 suitably may be provided with holes to accept the adjustment keeper. The adjustment keeper is to assist in keeping the tail strap 8 in place when weight is taken off the strap. However, the adjustment keeping device is not needed to support the weight of the guitar or other article.

While the preferred embodiment employs leather as the material for the strap elements, different materials and sizes can be used for all components. Other natural and man-made materials can be used including but not limited to nylon, cotton, and canvas. The main concern of the craftsperson is that the main strap 16 be flexible and that the tail 8 strap be stiff enough to push through the tunnel 9.

As noted above, in use, an adjustment keeping piece may suitably be provided to secure the length of the strap when adjusted. The adjustment piece may suitably comprise a Conway Buckle 17 manufactured by Keystone Mfg.& Supply co of Allentown Pa. part number 210 z or a Chicago Screw 18 manufactured by Keystone Mfg.& Supply co of Allentown Pa. part number 973 ST NP. A suitable Sam Browne button 19 is sold by eleathersupply.com as item numbers 130901 or 130902, for example. An issue to address with the adjustment keeping piece is that something is used when pressure is taken off the strap to keep the two straps portions from losing their relative adjustment place, should this be desired.

While the preferred use is in connection with a guitar, the strap according to the invention could be used on other items that carries weight and go over the shoulder, such as back pack, purse or the like.

Accordingly, the invention provides an improved strap that is adjustable, carries the weight over a larger area than with traditional guitar straps, does not bunch up as with conventional straps, has the appearance of being one piece, and is comfortable. One strap is carried inside the other and the pieces cooperate to form one strap out of two through compression of the main strap and tail strap. The compression method eliminates the weight of the guitar or article being put on a concentrated location and carries the weight of the guitar or article over the shoulder at a length of about 10-12 inches. This eliminates a concentration of stress on a small and specific location such as a buckle or slit and a possible point of failure. Also the strap will lay smoother over the shoulder making it more comfortable. It also has the appearance of being one piece.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A strap comprising:

a first strap portion having a receiving tunnel therein, said first strap portion having a length and said tunnel running a substantial portion of said length, said first strap portion having an opening at one end and said first strap portion being closed at an opposite end, said opening and closed further defining said tunnel; and a second strap portion adapted to slidingly fit within the receiving tunnel, said length of said tunnel being enough to allow said second strap portion to be carried over a user's shoulder when in use, wherein in use, weight of an article on the first strap portion and on the second strap portion in opposing directions collapses the tunnel and compresses the first strap portion in an area over a user's shoulder to compressively interact with the second strap portion to maintain an adjustment position thereof.

2. The strap according to claim 1, wherein said first and second strap portions comprise leather.

3. The strap according to claim 1, wherein said first strap portion is wider than said second strap portion.

4. The strap according to claim 1, further comprising a position keeper for maintaining said first and second strap portions relative to one another.

5. The strap according to claim 4, wherein said position keeper comprises a buckle.

6. The strap according to claim 4, wherein said position keeper comprises a post and corresponding receiving opening.

7. The strap according to claim 6, wherein said post comprises a Chicago Screw.

8. The strap according to claim 6, wherein said post comprises a Sam Browne button.

9. The strap according to claim 1, wherein said strap comprises a guitar strap.

10. A strap for supporting an article over a wearer's shoulder and back, comprising:

a fixed strap portion; and an adjustable strap portion, wherein said fixed and adjustable strap portions are adjustably positionable relative to one another to adjust the overall length of the strap, wherein the overall length adjustment is maintained by frictional engagement of the strap portions to one another, wherein, said fixed strap portion has a length and a tunnel running a substantial portion of said length, said fixed strap portion having an opening at one end and said fixed strap portion being closed at an opposite end, said opening and closed further defining said tunnel;

said length of said tunnel being enough to allow said adjustable strap portion to be carried over a user's shoulder when in use, wherein in use, weight of an article on the fixed strap portion and on the adjustable strap portion in opposing directions collapses the tunnel and compresses the fixed strap portion in an area over a user's shoulder to compressively interact with the adjustable strap portion to maintain an adjustment position thereof.

11. The strap according to claim 10, wherein said fixed strap portion comprises first and second surfaces adjacent one another adapted for receiving said adjustable strap portion therebetween and for providing frictional engagement thereof.

12. The strap according to claim 11, where at least portions of said first and second surfaces form sidewalls of a tunnel portion adapted to slidingly receive said adjustable strap portion therein in absence of compression of the first and second surfaces, and to frictionally engage said adjustable strap portion in presence of compression of said first and second surfaces.

13. The strap according to claim 10, wherein said fixed strap portion comprises leather.

14. The strap according to claim 10, wherein said adjustable strap portion comprises leather.

15. The strap according to claim 10, further comprising a position keeper for maintaining said fixed and adjustable strap portions positions relative to one another in absence of compression of the strap portions to one another.

16. The strap according to claim 15, wherein said position keeper comprises a buckle.

17. The strap according to claim 15, wherein said position keeper comprises a post and corresponding receiving opening.

18. The strap according to claim 10, wherein said strap comprises a guitar strap.

19. A method of providing an adjustable strap, comprising:

providing a first strap portion having a tunnel therein;

slidingly positioning a portion of second strap portion within a portion of said tunnel; and temporarily fixing the positions of the first and second strap portions to one another by compressing said tunnel to cause frictional engagement of the first and second strap portions to one another.

20. The method according to claim 19, further comprising adjusting the length of said adjustable strap, said adjusting comprising:

removing compression force from the first and second strap portions relative to one another, sliding the second strap to a new position, and compressing again said tunnel to temporarily fix the new positions of the first and second strap portions to one another.

* * * * *